US006745974B2

(12) United States Patent
Nelson

(10) Patent No.: US 6,745,974 B2
(45) Date of Patent: Jun. 8, 2004

(54) COLLAPSIBLE ROLLER ASSEMBLY

(76) Inventor: John E. Nelson, 457 Main St., Cold Brook, NY (US) 13324

( * ) Notice: Subject to any disclaimer, the term of this patent is extended or adjusted under 35 U.S.C. 154(b) by 0 days.

(21) Appl. No.: 10/219,166

(22) Filed: Aug. 16, 2002

(65) Prior Publication Data

US 2004/0031876 A1 Feb. 19, 2004

(51) Int. Cl.[7] ..... B65H 75/24
(52) U.S. Cl. ..... 242/573.4
(58) Field of Search ..... 242/573.4, 573.8, 242/573.7

(56) References Cited

U.S. PATENT DOCUMENTS 2,529,185 A 11/1950 Proctor
2,564,482 A * 8/1951 Kentis, Jr. ..... 242/573.4
4,500,046 A * 2/1985 Woenker ..... 242/573.4
5,904,315 A 5/1999 McInerney

* cited by examiner

*Primary Examiner*—John Q. Nguyen
(74) *Attorney, Agent, or Firm*—Robert O. Wright

(57) ABSTRACT

A take up roller for use in a continuous roll towel cabinet is shown which can after taking up the desired amount of toweling, be simply collapsed to have a smaller daimeter facilitating easy removel from the center of the accumulated toweling. A three segment cylinder is shown with a pair of end spindles that serve as the central shaft and expanding/collapsing member.

6 Claims, 2 Drawing Sheets

COLLAPSIBLE ROLLER ASSEMBLY

This invention relates to an expandable/collapsible roller assembly and more particularly to a collapsible take up roller assembly for use in continuous roll towel cabinets.

BACKGROUND OF INVENTION

In the continuous roll towel industry a roll of clean towel material is placed in a cabinet, fed through a dispensing mechanism so as to present a clean portion of toweling to a user, and the soiled toweling taken up on a take up roll for subsequent laundering or other processing. When the entire roll of clean toweling has been used and wound up on the soiled towel take up roll the soiled toweling must be removed and taken to a laundry for cleaning. As the soiled toweling is wound up on the take up roll it increasingly tightens itself about the roll portion so that it is frequently very difficult to slip or slide the roll of soiled toweling off the take up roll to remove the toweling for laundering.

Various expandable/collapsible reels, sleeves and spindles have been proposed for solving particular problems in the slit steel, wire and other industries but they have all been complicated and expensive mechanisms and totally unsuitable for the roll towel industry.

OBJECTS OF INVENTION

Accordingly it is an object of the present invention to provide a collapsible roller assembly that overcomes the disadvantages of the prior art.

It is another object of the present invention to provide a simple, economical yet rugged collapsible take up roller for a roll towel cabinet.

It is yet another object of the present invention to provide a collapsible take up roller assembly that can be substituted for conventional take up rollers in continuous roll towel devices without requiring changes in the existing roll towel devices.

It is a still further object of the present invention to provide a collapsible take up roller assembly that can be made of economical water and corrosion resistant materials.

These and other and further objects of the present invention are obtained in one embodiment in which three outer roll segments are maintained in a collapsed condition by three elastic o-rings and expanded to operative position by axial insertion of a pair of spindle members, having at least one truncated cone caming member mounted thereon, adapted to mount the take up roller assembly in a conventional roll towel cabinet

DESCRIPTION OF PREFERRED EMBODIMENTS

Figure 1:
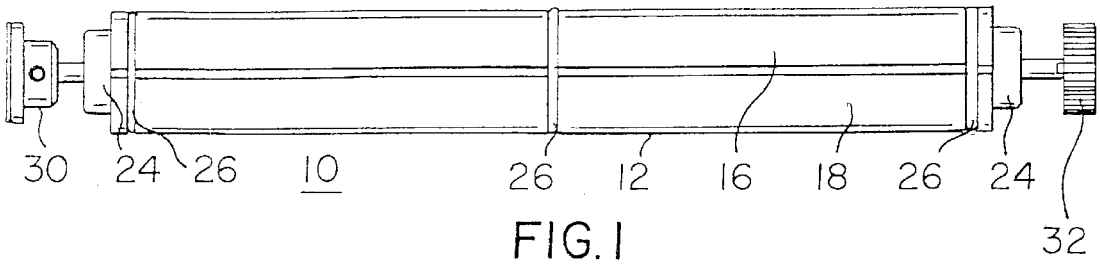
FIG. 1 is a plan view of a collapsible roller assembly according to the present invention.

Referring now to FIG. 1 collapsible roller assembly 10 has a cylindrical body portion 12 made up of three segments

Figure 2:
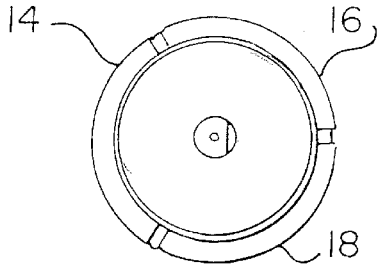
FIG. 2 is an end view of FIG. 1 taken from the left end.
Figure 3:
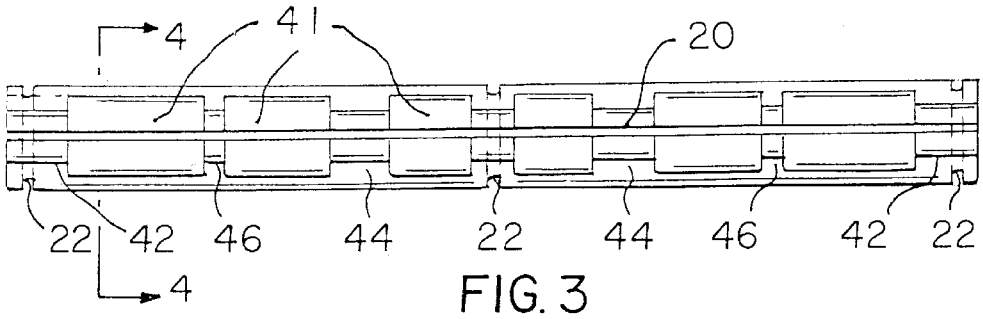
FIG. 3 is an interior plan view of a segment of the roller in FIG. 1.
Figure 4:
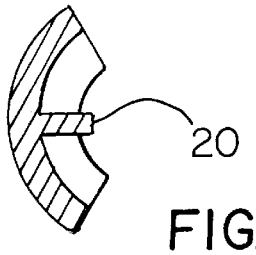
FIG. 4 is a sectional view taken on line 4—4 of FIG. 2.

14, 16, and 18. As may be seen best in FIGS. 2 and 4 each segment comprises about 120 degrees of said cylindrical body portion 12 with the outer surface forming approximately one third of the circumference of the body portion 12. Each segment 14–18 has a rib 20 extending the full longitudinal length thereof.(see FIGS. 3 and 4) Each segment 14–18 also has three small grooves 22 (FIG. 3) in the outer surface thereof one at each end and one in the middle.

Positioned within body portion 12 at each end thereof are spindle members 24 (see FIGS. 1 and 5) which act not only as the mounting shafts for the roller assembly 10 in a continuous roll towel machine, but also function as the caming members for expanding the segments 14–18 into the paper receiving position when the spindles are in the full axial inserted position. Three elastic "O" rings 26 (FIG. 1) are mounted in the grooves 22 and are sized to keep the segments 14–18 in the retracted or collapsed position unless forced to the expanded position, by the cam surfaces of the spindle members 24, as shown in FIG. 1.

Figure 5:
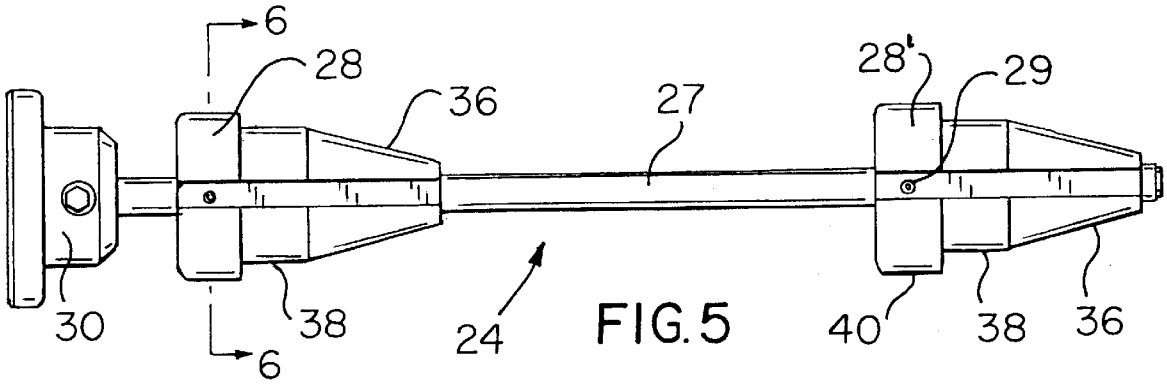
FIG. 5 is a plan view of the left hand spindle of FIG. 1.
Figure 6:
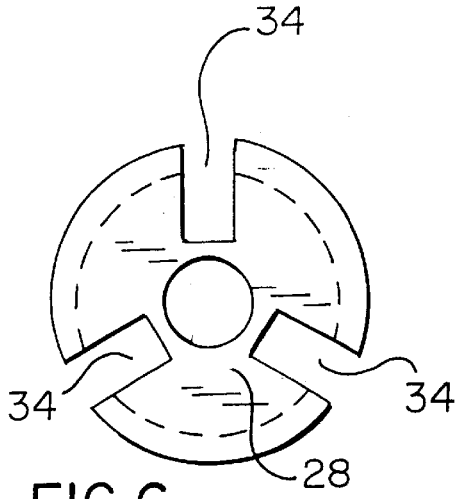
FIG. 6 is a sectional view taken on line 6—6 of FIG. 5.

As shown in FIG. 5 spindle members 24 include a shaft 27 carrying a pair of truncated cones 28 and 28' fixed thereto by suitable means such as spring roll pins 29. Shaft 27 also carries at the outer end a knob 30 or a gear 32 as the case may be, as required to interface with a particular application. The space between the knob 30 and gear 32 and the outer cone members 28 are provided to serve as shaft mounting areas when installed in a roll towel machine. Cone members 28 and 28' each have three radial slots 34 (FIG. 6) formed to receive ribs 20 of the segments 14–18 when assembled thereabout, in this fashion the spindles 24 and roller segments 14–18 are maintained in proper radial alignment. Cone members 28 and 28' also each have a tapered cam surface 36 and two flat circumference surfaces 38 and 40 with surface 40 having the larger diameter.

The cylindrical body portion segments 14–18 each have six interior cavities 41 spaced along the length thereof and separated by annular ring members 42, 44, and 46. Ring members 42 and 44 are sized to coperate with cam surfaces 38 to hold the segments 14–18 in the expanded position when spindles 24 are fuly inserted into the segments.

When assembled as shown in FIG. 1 spindles 24 are inserted into the roller segments until circumference 40 which functions as a flange abuts the ends of the roller segments 14–18. In this position spindle surfaces 38 contact the smaller diameter inner segment rings 42 and 44 and hold the segments in the expanded roller configuration (see FIG. 2). When the spindles 24 are withdrawn to the collapsed position the rings 42 and 44 slide down the cam surfaces 36 allowing the "O" rings 26 to compress the roller segments 14–18 into the collapsed position about shaft 27. As the spindles 24 are withdrawn from within the roller segments the flange surface 40 of the cone 28' on the inner end of the spindles is stopped by rings 46 on the inner surface of the roller segments 14–18.

As shown in FIG. 1 the outer end of the left hand spindle has formed thereon a mounting knob 30 adapted to fit in the cabinet roll mounting bracket and the right hand spindle has a gear 32 on the end thereof to operatively engage with the towel transport mechanism of the towel cabinet to drive the take up roller assembly.

In operation the collapsable roller assembly 10 is installed in a towel cabinet in the expanded condition and a towel web is wrapped around the body 12. When the desired amount of towel is taken up by the roller assembly body 12 the entire assembly of soiled towel and collapsible roller is removed from the cabinet. The two spindles 24 are then pulled along the longitudinal axis outwardly to the collapsed position and the roller segments 14–18 are drawn together by the "O" rings 26 which decreases the roller diameter sufficiently so that the roller assembly 10 can be easily removed from the rolled up soiled towel. The roller assembly 10 may then be reinstalled in the towel cabinet and the cycle restarted. The soiled towel may then be sent to the laundry in the normal course. A very simple, easy to operate and economical to manufacture collapsible roller assembly is thus provided.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use.

I claim:

1. In a continuous roll towel dispenser mechanism a collapsible take up roller assembly comprising in combination:

an elongated generally hollow cylindrical body portion formed from at least two radially separable arcuate cross sectioned segments;

a plurality of annular ring members formed at spaced intervals along the inner surface of each said body portion segments and extending inwardly therefrom;

a pair of elongated spindle members positioned within the opposite ends of said at least two body portion segments adapted to be moved longitudinally from a "collapsed" to an "expanded" position;

each of said pair of elongated spindle members having a plurality of cam surfaces spaced along the length thereof;

said spindle member cam surfaces being formed and spaced along said spindle to be in operative relationship to said ring portions on the inner surface of said roller assembly segments when said segments and spindles are positioned in the "expanded" position;

at least one narrow circumferential groove formed in the outer surface of said roller assembly body segments;

an elastic "O" ring member positioned in said at least one narrow groove and sized to hold said assembly roller body segments in a closed position when joined together about said spindle members positioned in the longitudinal "collapsed" position; and said "O" ring member having sufficient elasticity to allow said roller assembly body segments to be moved radially outwardly to an open position when said spindle members are moved longitudinally a predetermined distance into the ends of said assembled body segments to the "expanded" position to cam said body segments radially outwardly.

2. The assembly as claimed in claim 1 further including means formed on the outer ends of said pair of spindle members to form mounting and driving means for said collapsible assembled roller when said assembled roller is positioned in a towel cabinet.

3. The assembly as claimed in claim 1 further including:

at least one longitudinal rib member formed on said radially separable arcuate body portion segments and extending inwardly therefrom;

each of said pair of elongated spindle members having at least two longitudinal slots in said cam surfaces sized to receive therein said at least one longitudinal rib member of one of said body portion segments; and said ring members and cam surfaces being positioned to cause inward longitudinal movement of said spindle members to the "expanded" position to move said body portions to the open position and outward longitudinal movement of said spindle members to the "collapsed" position to move said body portions to the closed position.

4. The assembly as claimed in claim 1 wherein said cam surfaces on said spindle members comprise a pair of spaced apart truncated cones mounted on each separate spindle member.

5. The assembly as claimed in claim 4 wherein said plurality of ring members on the inner surfaces of said body portions comprise at least two cam surfaces and two stop members adapted to operatively engage with said two spindle member truncated cone cam members.

6. The assembly as claimed in claim 1 wherein said cylindrical body portion comprises three longitudinal segments each having an identical curved cross section approximating one hundred twenty degrees of a circle, so as to form an elongated cylinder when assembled together in abutting relationship.

* * * * *